United States Patent [19]

Smolik

[11] 3,979,978

[45] Sept. 14, 1976

[54] NAIL SETTING TOOL

[76] Inventor: Robert A. Smolik, 670 W. 7th St., St. Paul, Minn. 55102

[22] Filed: June 30, 1975

[21] Appl. No.: 591,518

Related U.S. Application Data

[63] Continuation-in-part of Ser. No. 470,013, May 15, 1974, abandoned.

[52] U.S. Cl. ..... 81/120; 144/2 R; 144/134 R; 144/136 R; 144/326 R

[51] Int. Cl.[2] ..... B25B 13/04

[58] Field of Search ..... 81/120, 54; 145/46; 227/147; 144/2 R, 134 R, 136 R, 136 H, 323, 326 R

[56] References Cited

UNITED STATES PATENTS

| | | | |
|---|---|---|---|
| 906,040 | 12/1908 | Lucas | 81/53.2 |
| 1,321,776 | 11/1919 | Stepanian | 81/120 |
| 1,336,794 | 4/1920 | Stepanian | 81/120 |
| 2,839,754 | 6/1958 | Pfaff | 227/147 |

FOREIGN PATENTS OR APPLICATIONS

| | | | |
|---|---|---|---|
| 920,402 | 3/1963 | United Kingdom | 81/53.2 |

*Primary Examiner*—James L. Jones, Jr.
*Attorney, Agent, or Firm*—Burd, Braddock & Bartz

[57] ABSTRACT

A tool for setting nails or like linear fasteners in hard wood, concrete or other hard surfaces. The tool is usable in conjunction with a power implement having a rotary working portion, such as an electric drill, and is adapted to be secured in the rotary portion of the power implement for rotation therewith. The tool includes a first means to grip the nail head to effect rotation of the nail with the tool. The first means can include a novel wrench according to the invention. A second means engages the nail shank to axially align the nail with the axis of rotation of the working portion of the power implement. Manual pressure exerted through the power implement advances the rotating nail into the surface.

19 Claims, 11 Drawing Figures

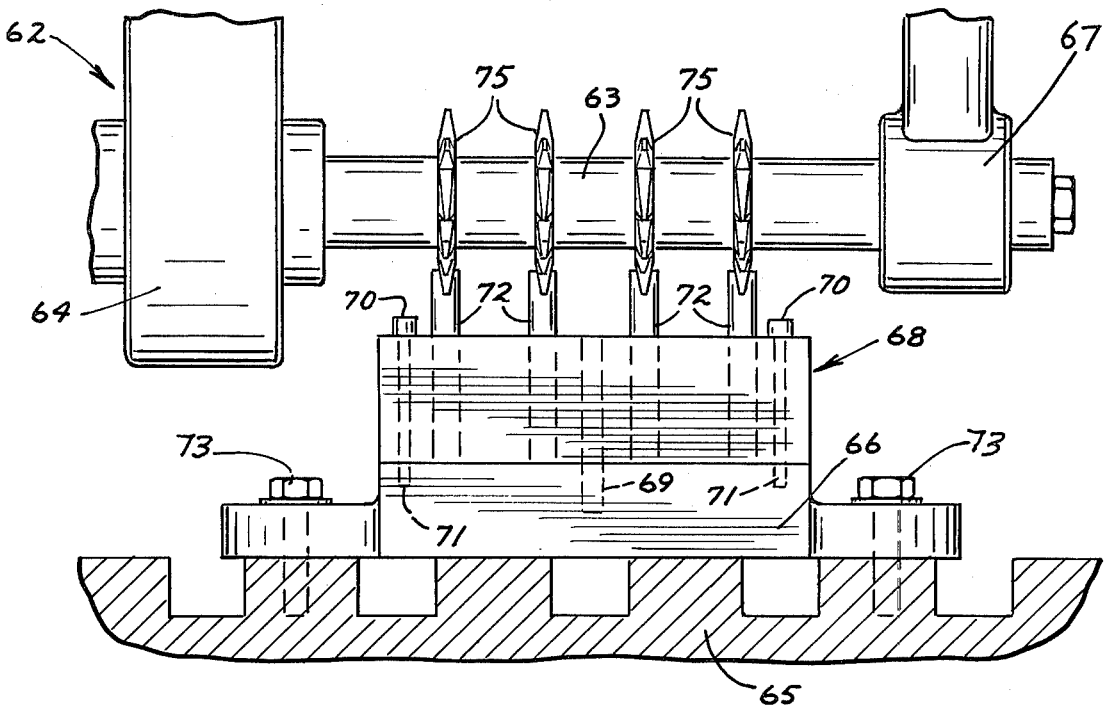
FIG. 11
FIG. 7
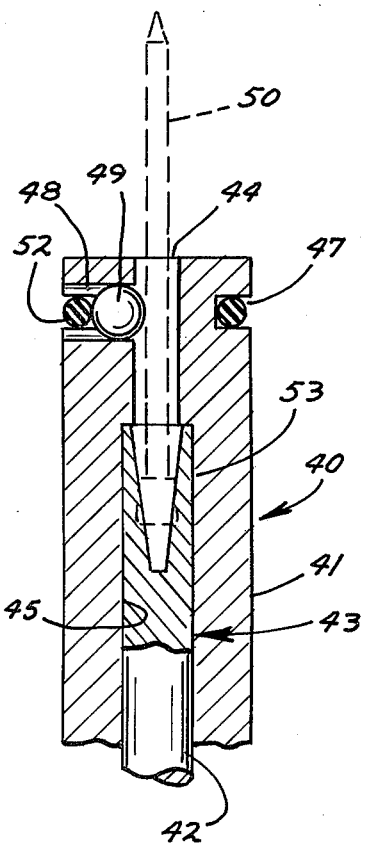
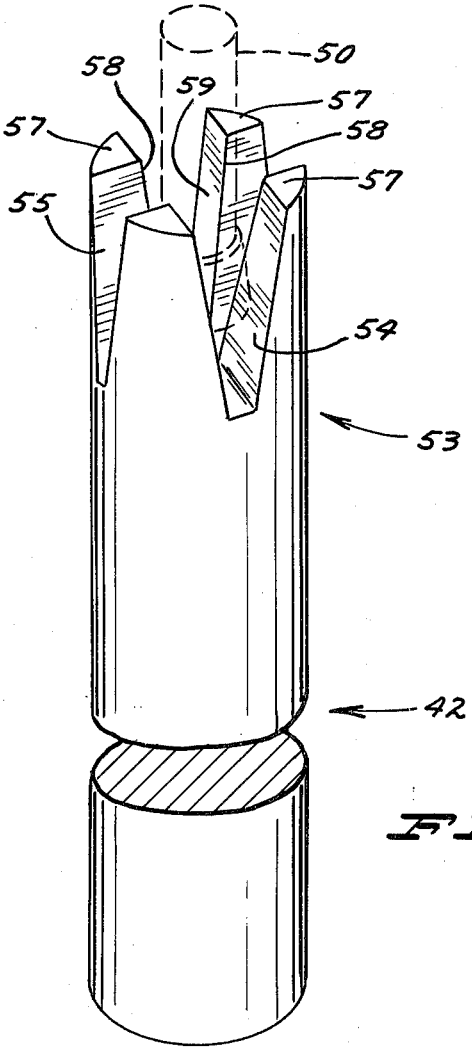
FIG. 8

NAIL SETTING TOOL

CROSS REFERENCE TO RELATED APPLICATION:

This application is a continuation-in-part of U.S. Application Ser. No. 470,013 filed May 15, 1974, now abandoned.

BACKGROUND OF THE INVENTION

In the field of carpentry, the setting of nails in hard wood is sometimes difficult, as in the nailing of fir or other hard wood strips during construction or repair of a dwelling. The setting of nails entirely with a hammer is tedious and often leads to bent nails. Usually it is necessary to drill a small pilot hole in which to set the nail for pounding with a hammer.

The same difficulty is encountered when attempting to set the nail in other hard surfaces such as concrete. In addition, difficulty is encountered when attempting to place a nail near the edge of a board, as when installing stair risers, as the board is apt to split to the edge.

Some workers use tools in association with impact devices such as pneumatic hammers to drive the nail or other fastener into the hard surface. These tools commonly employ a movable plunger which impacts upon the head of the nail to drive it in the same fashion as a hammer. For example, see U.S. Pat. No. 2,839,754 to Pfaff and U.S. Pat. No. 2,472,353 to Sittert et al. As often as not, such an impact device and related equipment for use with such tools are not available to the worker due to the expense and the limited use thereof. The worker is more likely to have on hand smaller tools such as a rotary power drill.

Other devices provide means to simply hold the nail in proper alignment while a plunger is driven against the head of the nail by a hammer. See U.S. Pat. No. 3,060,440 to Pfaff et al, and U.S. Pat. No. 2,199,833 to Fleischman. Such devices still require the initial motive and manual power of the hammer to set the nail.

SUMMARY OF THE INVENTION

The invention relates to a tool for the setting of nails or like linear fastening devices in hard surfaces such as hard wood, concrete, etc. The tool is usable with a power implement having a rotary working portion, such as an electric drill. The tool is operative to drive the nail under rotating action part way into the surface whereby a hammer is usable to finish driving the nail.

In a preferred embodiment, the tool has a shaft which is conventionally chucked in the rotary jaws of an electrically powered hand drill. The tool includes a grip means to engage and releasably grip a nail head for rotation with the tool. The grip means can include a novel wrench according to one form of the invention. Guide means on the tool engage the nail shank and axially align the nail with the axis of rotation of the rotary jaws. As shown, the guide means can include a plurality of steel balls equally spaced about the circumference of the nail shank and resiliently making contact therewith. The nail is rotatably driven into the hard surface upon the application of longitudinal pressure exerted through the hand drill.

An object of the invention is to provide a tool for the setting of nails or like fastening devices in a hard surface. The second object of the invention is to provide such a tool usable with a powered implement having a rotary working portion. The third object of the invention is to provide such a tool operable to rotatably drive a nail into a hard surface. Further objects of the invention will become apparent upon the following description.

IN THE DRAWINGS

FIG. 7 is a fragmentary view in section showing another form of a nail setting tool according to the present invention;

FIG. 8 is an enlarged perspective view of the shaft of the nail setting tool of FIG. 7;

FIG. 11 is an elevational end view of the machinery of FIG. 9 for diagrammatic illustration of the method of the invention.

DESCRIPTION OF A PREFERRED EMBODIMENT

Figure 1:
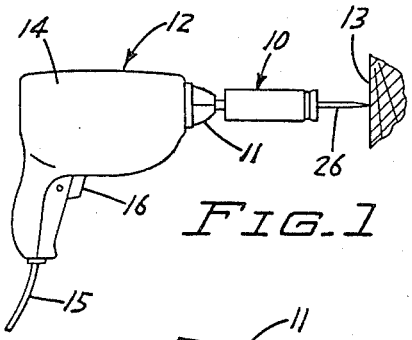
FIG. 1 is an elevational view of the setting tool of the invention installed in an electric drill and holding a nail preparatory to the setting thereof in a piece of hard wood.

Referring to the drawings, there is shown in FIG. 1 a nail setting tool 10 according to one form of the present invention. Nail setting tool 10 is installed in a power implement having a rotary working portion, or, in particular, in the jaw assembly 11 of an electric hand drill 12. As shown in FIG. 1, nail setting tool 10 is in proximate position to a piece of wood 13 preparatory to setting a nail therein. Electric drill 12 is of a conventional variety having a housing 14 containing an electric motor (not shown) supplied with electric power through cord 15 and actuated by depression of trigger 16. Actuation of the electric motor effects rapid rotation of the jaw assembly 11 as is well known.

Figure 3:
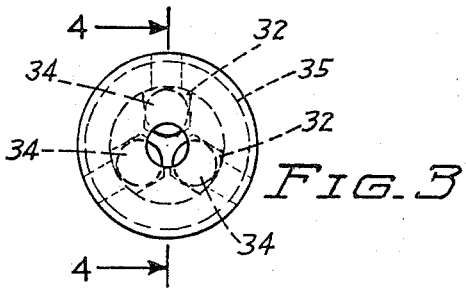
FIG. 3 is an open view of the setting tool of FIG. 2.
Figure 2:
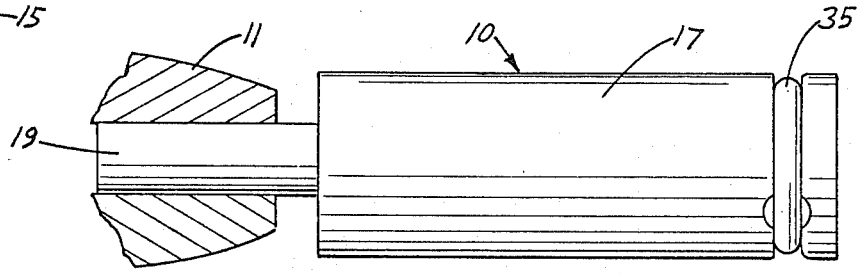
FIG. 2 is an enlarged view of the setting tool of the invention installed in the jaws of an electric drill.
Figure 4:
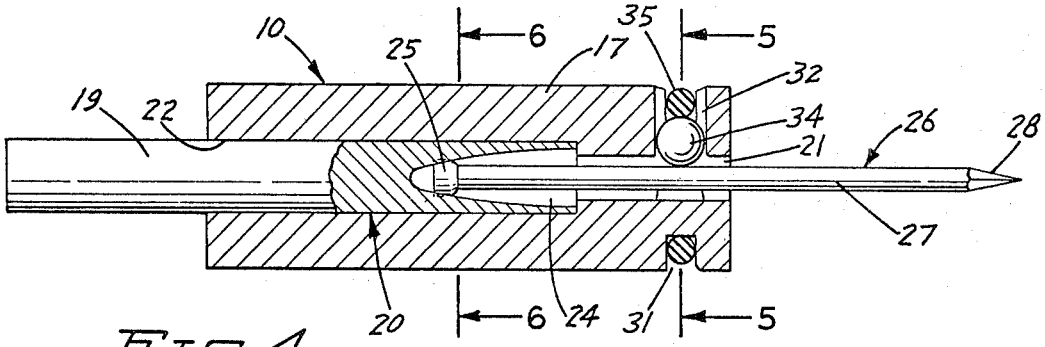
FIG. 4 is a sectional view taken along the line 4—4 of FIG. 3, and showing a nail installed in the tool.

As shown in FIGS. 2 through 4, setting tool 10 includes a generally cylindrical body portion 17 and a shaft or stem 19 extending rearward therefrom and having a longitudinal axis aligned with that of body portion 17. Body portion 17 has a centrally located axial bore 20 having a reduced forward section or forward axial bore 21 and an enlarged rearward section 22. The inward end of shaft 19 fills and is forceably fitted into the enlarged rearward portion 22 of axial bore 20. The rearwardly, outwardly extended portion of shaft 19 is securely chucked in the jaws 11 of electric drill 12 whereby rotation of the jaws 11 effects rotation of the shaft 19 and the body portion 17 of setting tool 10.

Figure 6:
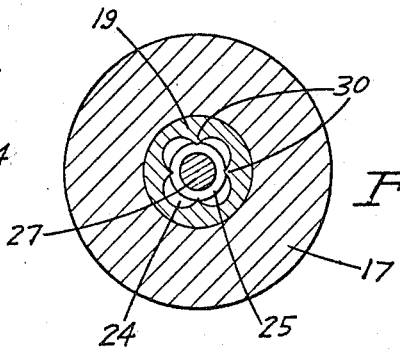
FIG. 6 is an enlarged sectional view taken along the line of 6—6 of FIG. 4.

Setting tool 10 has means for holding, gripping and guiding a nail or other linear fastener upon advancement of the nail into a hard surface under rotating action of the jaws 11 of drill 12. The interior end of shaft 19 adjacent forward axial bore 21 is provided with a rearwardly tapered hole 24 constituting an extension of forward axial bore 21. Hole 24 is tapered to accommodate the heads of varying sizes of nails. As shown in FIG. 4, the head 25 of a finishing nail 26 is locatable in hole 24 with the shaft 27 of nail 26 extending forwardly through the forward axial bore 21, outwardly of setting tool 10 and terminating in nail point 28. Hole 24 has a plurality of circumferentially spaced, rearwardly tapered or converging ridges or ledges 30 each having an apex projecting radially inward hole 24 as shown in FIG. 6. Nail 26 is fitted into hole 24 through forward axial bore 21 to an extend that the head 25 is releasably gripped by the plurality of mutually opposed ledges 30. It may be seen that the inward convergence of the ledges 30 permits nails of varying sizes of heads to be inserted into and gripped in the hole 24. The ledges 30 in hole 24 form a wrench to grip the nail head 25 sufficiently so that rotation of setting tool 10 forces rotation of the nail 26. Other suitable means could be provided for the gripping of the nail head 25, the criteria being that the nail head be quickly insertable in the gripping means, and quickly releasable once the nail has been set in the hard surface.

While the hole 24 may be formed in a number of suitable ways, one satisfactory method is to first drill in the end of shaft 19 a circular hole, then form the plurality of ledges 30 through the use of a tapered carbide burr.

Figure 5:
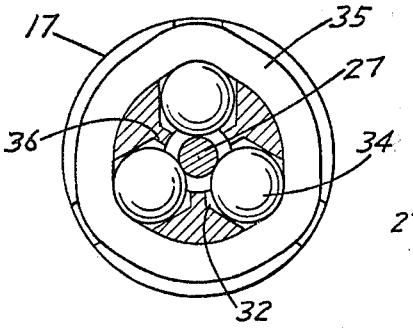
FIG. 5 is an enlarged sectional view taken along the line 5—5 of FIG. 4.

There is shown in FIGS. 3 through 5, located forward of the hole 24, guide means for holding and guiding the shank of nail 26. Toward the forward end of body portion 17 is a circumferential groove 31 described in the outer perimeter of body portion 17. A plurality of three radial bores 32 open to groove 31 and extend radially inward from the inner face of groove 31 to intersect the forward axial bore 21 at right angles. The radial bores 32 are equally spaced about the perimeter of groove 31 and intersect each other at equal angles. Movably located in each radial bore 31 is a biasing contact member constituted in a preferred embodiment as a metallic sphere or ball 34. The diameter of each radial bore 31 is of a sufficient dimension to accommodate each ball 34 and allow movement of the ball therein. Bias means to bias the balls 34 inwardly of the radial bores 31 includes a resilient ring or an O-ring 35, preferably of rubber, located in and coextensive with the circumferential groove 31. O-ring 35 makes biasing contact with a portion of each ball 34 to bias it inward toward the forward axial bore 21.

Without a nail installed in the tool 10, the plurality of balls form a symmetrical configuration as shown in FIG. 3. In such an orientation the balls may or may not be in contact with each other depending on whether or not there is optionally provided interior stopping edges at the intersection of each radial bore 32 and the forward axial bore 21, as shown at 36 in FIG. 5. Such means may optionally be provided to limit the inward movement of the balls 34 as when the diameter of the forward axial bore is larger than the diameter of the balls 34 and there is a possibility of the balls falling into the axial bore.

The operation of the setting tool 10 will now be apparent. Shaft 19 is chucked into the jaws of a conventional electric drill 12 of the type which most workmen have at hand when performing carpentry or like operations. The head 25 of a nail 26 is inserted in the forward axial bore 21. The array of balls 34 part against the biasing of the O-ring 35 to allow passage of the nail head 25, then close about the nail shank 27. The balls 34 make symmetrical, biasing contact about shank 27 to maintain it in axial alignment with the forward axial bore 21 and thus aligned with the axis of rotation of the jaws 11 of drill 12. The nail 26 is inserted in the forward axial bore 21 to an extent where the head 25 engages the ledges 30 located in the tapered hole 24. The point 28 of the nail 26 and the portion of the shank 27 emerge from the front of the setting tool as shown in FIG. 4.

Upon rotation of the jaws 11 of drill 12, tool 10 forces rotation of the nail 26. The drill 12 is manually advanced toward the hard surface whereby the rotating nail point 28 burrows into the surface. Typically, nail points have sharp, converging edges which assist in the burrowing or drilling action. When the nail 26 has advanced into the surface a sufficent distance whereby it is firmly set, the drill 12 is stopped and pulled away from the nail 26. The tool 10 readily releases the nail 26. Balls 34 part against the bias of O-ring 35 to allow passage of the nail head. A conventional hammer is used to finish driving the nail into the surface.

The nail is quickly and easily set in the hard surface without the danger of bending or the possibility of splitting the wood. The operation is much quicker than drilling the conventional pilot hole to set the nail.

While the tool has been shown and described for use in an electric drill, it is apparent that the advantages of the tool are obtainable when used with a manually powered device as well.

Figure 9:
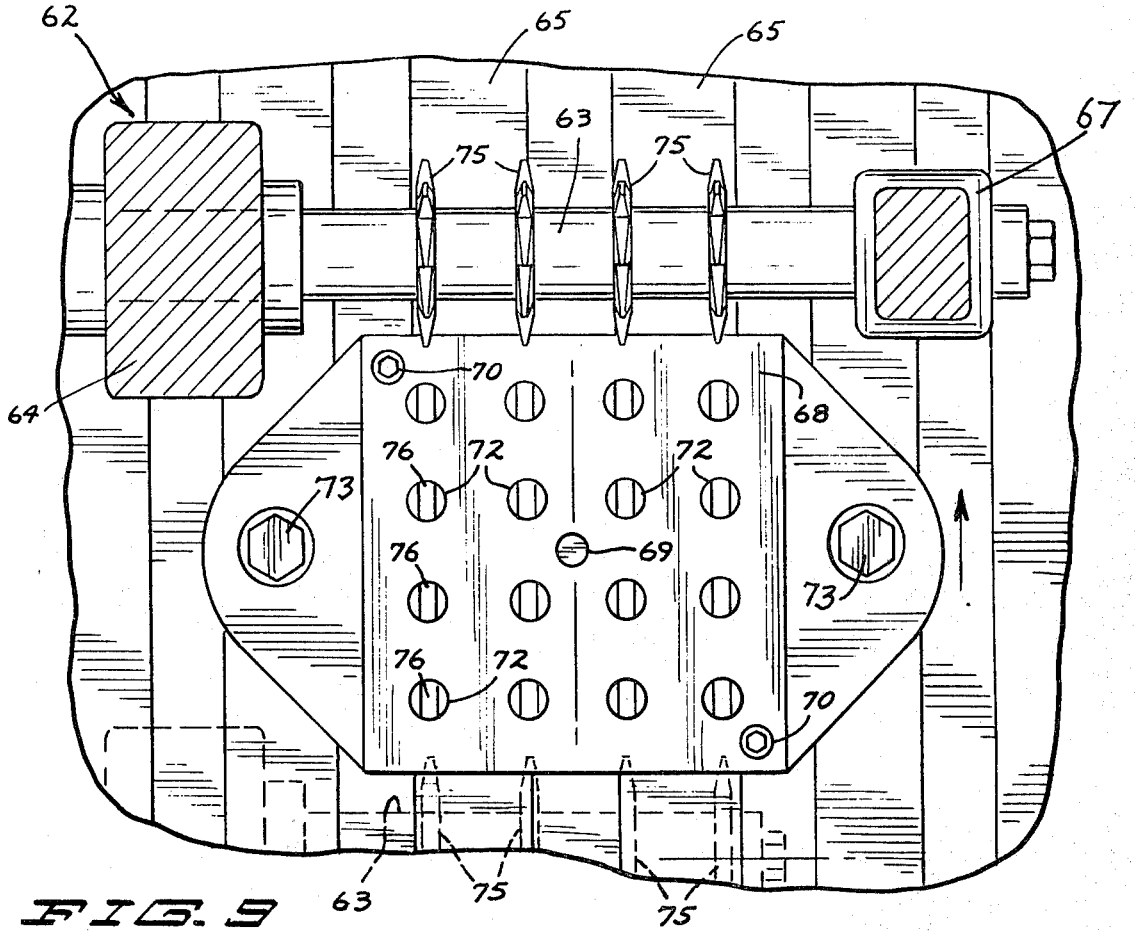
FIG. 9 is a top plan view for illustration of a method of fabricating wrench shafts for nail setting tools according to the present invention.
Figure 10:
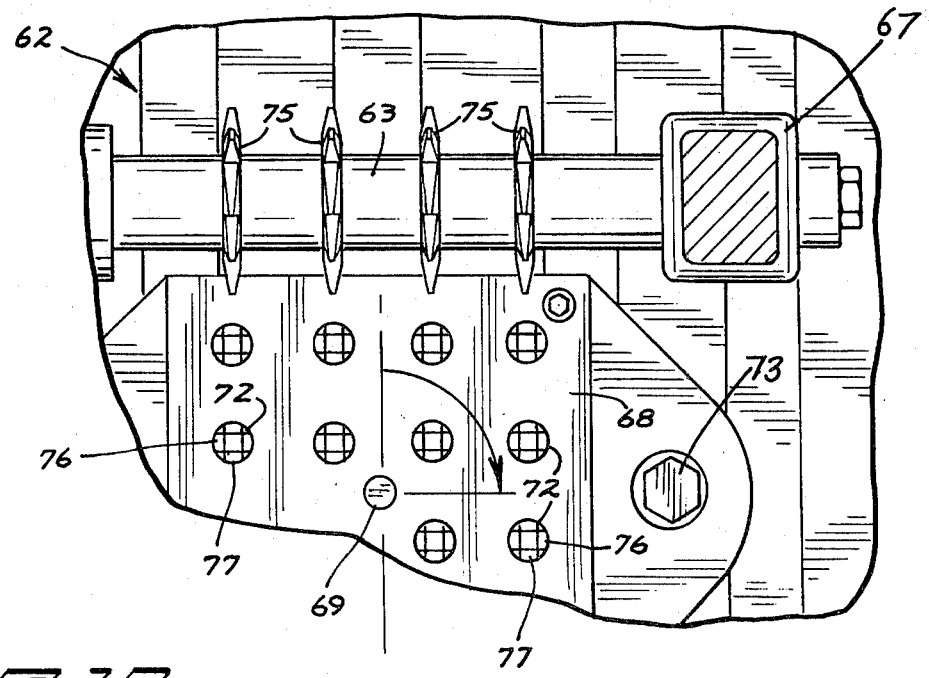
FIG. 10 is a fragmentary view of the machinery of FIG. 9 with a work jig rotated to a second position.

Referring to FIGS. 7 and 8, there is shown a nail setting tool according to another form of the invention, and FIGS. 9 through 11 show a method of making such a nail setting tool and in particular a shaft wrench for the tool.

FIG. 7 is a fragmentary, sectional view of a nail setting tool 40 having a generally cylindrical body portion 41 and an axially aligned shaft or stem 42 extending rearward therefrom. Body portion 41 has a centrally located, axial bore 43 having a reduced forward section or forward axial bore 44 and an enlarged rearward section 45. The rearwardly, outwardly extended end of shaft 42 can be chucked in the jaws of an electric drill whereby rotation of the jaws effects rotation of the shaft 42 and the body portion 41 of setting tool 40.

Guide means located at the forward end of the body portion 41 are provided for holding and guiding the shank of a nail or other linear fastener. Toward the forward end of body portion 41 is a circumferential groove 47 described in the outer perimeter thereof. A plurality of radial bores 48 open to the groove 47 and extend radially inward from the inner face of groove 47 to intersect the forward axial bore 44 at right angles. Biasing contact members 49 are movably located in the radial bores 48 for biasing contact with a nail shank located in forward axial bore 44, indicated in phantom at 50. Bias means to bias the movable contact members 49 inwardly of the radial bores 48 can include a resilient ring or an O-ring 52, as shown, located in the coextensive with the circumferential groove 47. Other suitable guide means can be provided.

The interior end of shaft 42 is force fitted into the enlarged rear portion 45 of axial bore 43. The interior end of shaft 42 includes a wrench 53 for releasably gripping the head of a nail or other such linear fastener and causing rotation thereof along with shaft 42 for advancement into a hard surface. Referring to FIG. 8, wrench 53 is formed of a first V-shaped groove 54 formed or cut diametrically across the end of shaft 42 and converging longitudinally from the end of shaft 42 or in a direction parallel to the longitudinal axis of shaft 42. A second V-shaped groove 55 is formed or cut diametrically across the end of shaft 42 oriented to be perpendicular to the first groove 54. The second groove 55 also converges longitudinally grom the end of shaft 42. The first and second grooves 54, 55 form a plurality of four longitudinal tines or prongs 57 each having a 90° ridge 58 directed radially inward and downwardly converging to define a wrench socket 59. Wrench socket 59 is longitudinally converging from the end of shaft 42 and is formed of the plurality of spaced apart ridges 58 to accommodate varying sizes of heads of linear fasteners such as nails.

As assembled in nail setting tool 40 of FIG. 7, the wrench 53 of shaft 42 accepts the head of a linear fastener 50 having a shank aligned and guided by the movable contact members 49. Upon rapid rotation of the nail setting tool 40, the wrench 53 rotates the nail 50 to advance it into a hard surface. Once having set the nail 50 in a hard surface, the head thereof is readily releasable from the wrench 53 of shaft 42.

In terms of a method of fabricating a shaft 42 with a wrench 53, as shown in FIGS. 9 through 11, there is provided a horizontal milling machine 62 having a horizontal, longitudinally stationary, but axially rotatable work arbor 63 rotatably driven at one end by a suitable gear and motor arrangement schematically indicated at 64. An arm and bearing assembly 67 supports the opposite end of arbor 63. Conventional movable machine platform 65 holds a work table 66 (FIG. 11) in conventional fashion to permit horizontal movement thereof into and out of working proximity to cutters located on work arbor 63.

A jig 68 is mounted on work table 66 to hold the blank work pieces. Jig 68 is mounted for indexing or rotation of 90° about a vertical axis relative to work table 66, as by rotating about a pivot shaft indicated at 69, thus to enable turning of work pieces relative to the mill 62. Bolts 70, are assembled to the jig 68 and extend downward therefrom to engage suitable threaded holes 71 indexed on the surface of work table 66 to secure the jig 68 in a first position as shown in FIG. 9, and then in a second position rotated 90° from that shown in FIG. 9. Bolts 73 secure work table 66 to machine platform 65. Jig 68 has suitable fittings or holes to accommodate a plurality of blank work pieces or blank, cylindrical rods 72 disposed in an upright orientation having longitudinal axes parallel to the plane of the mill cutters. As shown in FIG. 9, the rods 72 are disposed in rectangular coordination or in a symmetrical array of rows and columns of equal numbers forming a square. Four rows and columns are shown although there could be more or less depending on the number of shafts 42 to be fabricated at the time.

Assembled to work arbor 63 for rotation therewith is a plurality of gang of mill cutters 75. With jig 68 in the first position of FIG. 9, each cutter 75 has its cutting edge in diametric alignment with all of the blank rods 72 of one of the rows of blank rods. When the jig 68 is rotated or indexed 90° to the second position of FIG. 10, each cutter has its cutting edge in diametric alignment with all of the blank rods 72 of a column of rods. Each cutter 75 has a tapered cutting edge preferably with an included angle of approximately 15–20°. The cutters are horizontally positioned above the blank rods 72 to cut in each rod 72 in a diametric, downwardly converging, generally V-shaped groove. The groove shape conforms to the contour of the cutter edge which can be straight or slightly curved.

In operation, blank rods 72 are fitted in jig 68 as shown in FIG. 9 with jig 68 in a first position. The cutters 75 are diametrically aligned with the rows of blank rods 72 as shown in phantom in FIG. 9. With cutters 75 operative, work table 66 is moved on machine platform 65 under work arbor 63 to the relative positioning shown in full lines in FIG. 9. The cutters 75 each cut a first, diametric, generally V-shaped groove 76 in each of the blank rods 72 in one of the rows. Upon release of bolts 70, jig 68 is then rotated 90° to a second position, as shown in FIG. 10, whereby the grooves 76 are oriented at a position 90° from their former position. The cutters 75 are diametrically aligned with the columns of rods 72. Work table 66 is then again moved with machine platform 65 under work arbor 63 and a second, diametric, generally V-shaped groove 77 is cut in each of the rods 72 by cutters 75. The second groove 77 is perpendicular to the first groove 76. As shown in FIG. 10, the rods 72 are completed, having first and second grooves 76, 77 cut therein. Upon completion of both cuts, the shaft 42 is completed having thereon the end wrench portion 53 defined by first and second, generally V-shaped, perpendicular grooves.

As shown, sixteen of the rods 42 are fabricated at one time although it is apparent that more or less could be fabricated. The particular method of the invention is useful in fabricating such wrenches even individually. The completed wrench as shown in FIG. 8 is usable in a nail setting tool of the type described and is also usable apart therefrom to grip and turn the end of any variety of linear, cylindrical member.

The embodiments of the invention in which an exclusive property or privilege is claimed are defined as follows:

1. A nail setting apparatus for the setting in a surface of a nail by rotating advancement of the nail of the type having a head at one end and a shank pointed at the opposite end, said nail setting apparatus including:

an electric powered hand drill having a rotatable jaw assembly and an electric motor connected to said jaw assembly for rapid rotation of the jaw assembly, said jaw assembly having a plurality of jaws movable toward each other to securely engage a shaft;

a tool body portion;

shaft means connected to and extending rearward from the body portion and engaged by the jaws of said drill for coaxial rotation of the jaws and the shaft means and the tool body portion;

said tool body portion defining an elongated cylindrical forward axial bore coaxial with the axis of rotation of the jaws and body portion and extending from the interior of the body portion to the forward end thereof;

gripping means located adjacent the interior end of said forward axial bore adapted to releasably grip the head of a nail and cause rotation of the nail with the tool body portion;

guide means on said body portion rotatable with said body portion and proximate the forward end thereof spaced from the gripping means sufficiently to linearly align said nail shank with the axis of rotation of the jaws and body portion;

said guide means including three radial bores intersecting said axial bore forward of the gripping means, three spherical balls, one spherical ball being located in each radial bore, and means to bias the spherical balls inward toward said axial bore to engage a portion of the shank of a nail when located in said axial bore whereby rapid rotation of said jaw assembly and manual pressure exerted on said hand drill is operative to advance a nail part way into a surface.

2. The nail setting apparatus of claim 1 wherein: said gripping means includes a plurality of mutually opposed ledges projected radially inward into said axial bore and adapted to engage a nail head.

3. The nail setting apparatus of claim 2 wherein: said mutually opposed ledges are rearwardly converging whereby the gripping means is adapted to engage varying sizes of nail heads.

4. The nail setting apparatus of claim 1 wherein: said tool body portion has a circumferential groove open to said radial bores, and said means to bias the movable contact members inward toward said axial bore includes a resilient ring located in said groove making biasing contact with said spherical balls.

5. A nail setting tool for setting in a surface a nail of the type having a head at one end and an elongated shank with a point at the opposite end, said tool usable with an electric powered hand drill of the type having rotating jaws closeable toward one another to engage the shaft of a tool, to rotatably advance a nail in a forward direction to set it in a surface, said nail setting tool including:

a generally cylindrical tool body portion having a rearward end locatable toward the jaws of an electric powered hand drill and a forward end opposite the rearward end;

said tool body portion having a centrally located axial bore having a reduced forward section and an enlarged rearward section;

a shaft having an inward end force fitting in the enlarged rearward section and a rearward outwardly extended portion adapted to be engaged by the jaws of a portable electric drill for coaxial rotation of the shaft and body portion with the jaws of the drill;

the inward end of said shaft having a forwardly open hole constituting a rearward extension of the reduced forward section of the axial bore of the body portion, said hole being rearwardly tapered to accommodate nail heads of varying sizes;

a plurality of circumferentially spaced, rearwardly converging ledges located in said hole each having an apex projecting radially inward into said hole to releasably grip a nail head and cause coaxial rotation of the nail with the shaft and body portion;

guide means located proximate the forward end of said tool body portion, said guide means including a circumferential groove described in the outer perimeter of the body portion located proximate the forward end of the body portion, a plurality of three equally spaced, radial bores open to the groove and extending radially inward from the groove to intersect the forward section of said axial bore at a location spaced ahead of the hole in said shaft, a spherical ball movably located in each radial bore and movable to a position having a portion located in the forward section of said axial bore, and bias means located in said groove biasing said spherical balls inwardly in said radial bores whereby said balls engage the shank of a nail located in said axial bore having a head gripped in the hole of said shaft for rotation of the nail with said shaft and body portion and advancement of the nail into a surface.

6. The tool of claim 5 wherein: said bias means includes a resilient rubber ring.

7. A nail setting apparatus for the setting in a surface of a nail of the type having a head and a shank, including:

an electric powered hand drill having a rotatable jaw assembly and an electric motor connected to said jaw assembly for rapid rotation of the jaw assembly;

a tool body portion having a forward axial bore extending from the interior of the body portion to the forward end of the body portion;

shaft means extending rearward from the body portion and engaging the jaw assembly of the electric powered hand drill for coaxial rotation of the shaft means and the body portion therewith;

gripping means located at the interior end of said axial bore adapted to releasably grip the head of a nail to cause coaxial rotation of the nail with the tool body portion; and guide means on said body portion rotatable with said body portion and proximate the forward end thereof to engage a portion of a nail shank, said guide means spaced from the gripping means sufficiently to linearly align said nail with the axis of rotation of the jaw assembly of the electric drill.

8. The apparatus of claim 7 wherein: said gripping means includes a plurality of mutually opposed ledges projected into said bore and adapted to releasably engage the head of said nail for rotation with the tool body portion.

9. The apparatus of claim 8 wherein: said tool body portion defines a plurality of radial bores intersecting said axial bore forward of the gripping means, said guide means including a plurality of movable contact members located in said radial bores; and including means to bias the movable contact members in engagement with the shank of said nail to maintain said nail in linear alignment with the axis of rotation of the jaw assembly of the electric drill.

10. The apparatus of claim 9 wherein: said movable contact members are spherical balls located in said radial bores.

11. The apparatus of claim 8 wherein: said mutually opposed ledges are rearwardly converging whereby the gripping means is adapated to engage varying sizes of nail heads.

12. A tool for use with a power implement having a rotary working portion to set a linear fastener of the type having a head and a shank, in a hard surface, said tool including:

a tool body portion having a forward axial bore for accommodation of a portion of a linear fastener;

shaft means having an interior end adjacent said forward axial bore and an end extending rearward from the body portion engageable with the rotary portion of the power implement for rotation therewith;

said shaft means having a wrench portion at the interior end thereof providing gripping means adapted to releasably grip a head of a linear fastener to cause rotation of the fastener with the tool body portion;

said gripping means including a first generally V-shaped, diametric groove formed in the interior end of said shaft means and a second, diametric, V-shaped groove angularly orientated relative to said first groove to provide a plurality of ridges directed radially inward to engage the head of said fastener; and guide means on said body portion spaced from the gripping means to linearly align said fastener with the axis of rotation of the rotary working portion of the power implement when the shaft means is engaged therewith.

13. The tool of claim 12 wherein: said second V-shaped groove is orientated perpendicular to said first V-shaped groove.

14. The tool of claim 13 wherein: said tool body portion defines a plurality of radial bores intersecting said axial bore forward of the gripping means, said guide means including a plurality of movable contact members located in said radial bores; and means to bias the movable contact members in engagement with the shank of said fastener to maintain said fastener in linear alignment with the axis of rotation of the rotary working portion of the power implement when the shaft means is engaged therewith.

15. The tool of claim 14 wherein: said movable contact members are spherical balls located in said radial bores.

16. The tool of claim 14 wherein: said plurality of radial bores includes three radial bores intersecting said axial bore forward of the gripping means, said movable contact members comprising three spherical balls located in said radial bores, and means to bias the spherical balls inward toward said axial bore to engage the shank of said fastener when located in said axial bore.

17. The tool of claim 16 wherein: said tool body portion has a circumferential groove open to said radial bores, and said means to bias the movable contact members inward toward said axial bore includes a resilient ring located in said groove making biasing contact with said spherical balls.

18. A wrench for engagement of the end of a linear, cylindrical member for axial turning of the member, comprising:

a shaft having a first end and a second end;

the first end of the shaft adapted for engagement by a tool for rotation of the shaft;

the second end of the shaft having a first generally V-shaped, diametric groove formed thereon inwardly converging along the axis thereof;

said second end of the shaft also having a second generally V-shaped, diametric groove formed thereon inwardly converging along the axis thereof and angularly orientated relative to the first groove whereby said first and second grooves form an inwardly converging wrench socket having a plurality of ridges directed radially inward for engagement of the end of a linear, cylindrical member.

19. The wrench of claim 18 wherein: said first groove and said second groove are orientated perpendicular to each other.

* * * * *

UNITED STATES PATENT AND TRADEMARK OFFICE

CERTIFICATE OF CORRECTION

PATENT NO. : 3,979,978

DATED : September 14, 1976

INVENTOR(S) : Robert A. Smolik

It is certified that error appears in the above-identified patent and that said Letters Patent are hereby corrected as shown below:

Column 2, line 13, "open" should be --end--.

Column 3, line 8, after "inward", --into-- is omitted.

Column 8, Claim 11, line 3, "adapated" should be --adapted--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*